US006318325B1

(12) United States Patent
Lechner

(10) Patent No.: US 6,318,325 B1
(45) Date of Patent: Nov. 20, 2001

(54) HYDRAULIC VALVE-PLAY COMPENSATION ELEMENT

(75) Inventor: Martin Lechner, Stuttgart (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 09/673,469

(22) PCT Filed: Apr. 9, 1999

(86) PCT No.: PCT/EP99/02402

§ 371 Date: Oct. 17, 2000

§ 102(e) Date: Oct. 17, 2000

(87) PCT Pub. No.: WO99/56007

PCT Pub. Date: Nov. 4, 1999

(30) Foreign Application Priority Data

Apr. 28, 1998 (DE) ..... 198 18 893

(51) Int. Cl.[7] ..... F01L 1/24

(52) U.S. Cl. ..... 123/90.55; 123/90.37; 123/90.46

(58) Field of Search ..... 123/90.35, 90.37, 123/90.43, 90.46, 90.49, 90.55

(56) References Cited

U.S. PATENT DOCUMENTS 4,633,827 * 1/1987 Buente ..... 123/90.55
4,977,867 * 12/1990 Rhoads ..... 123/90.49

FOREIGN PATENT DOCUMENTS 12 36 857 3/1967 (DE) .
36 35 110 4/1987 (DE) .
38 19 927 1/1989 (DE) .
42 25 012 7/1993 (DE) .
93 18 108 1/1994 (DE) .
03 24 085 7/1989 (EP) .
01 232103 9/1989 (JP) .

* cited by examiner

*Primary Examiner*—Weilun Lo
(74) *Attorney, Agent, or Firm*—Collard & Roe, P.C.

(57) ABSTRACT

The invention relates to a hydraulic valve-play compensation element. The aim is to prevent any change in the length from taking place when the engine is at a standstill. To this end, the leakage oil is guided into the space between the high pressure valve (4) and the valve (5), where it then reinforces the sealing effect of valve (5). When the engine is in operation, the valve (4) is kept open irrespective of the direction of throughflow by means for producing a defined force, for example, a pressure-loaded piston or by electromagnetic means.

7 Claims, 1 Drawing Sheet

HYDRAULIC VALVE-PLAY COMPENSATION ELEMENT

Figure 1:
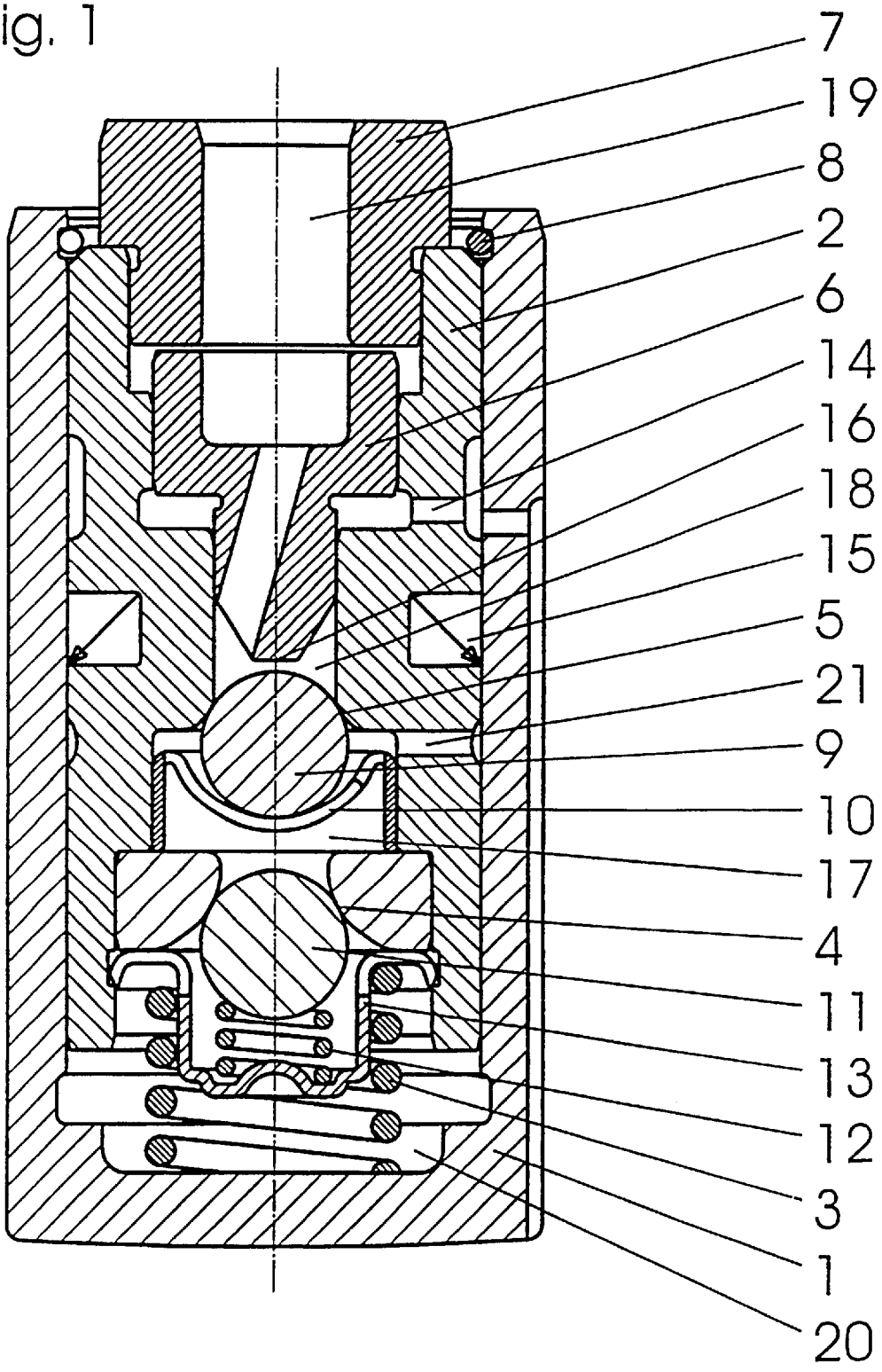

The invention relates to a hydraulic valve-play compensation element (HVC). In connection with hydraulic valve play compensation elements, the re-adjustment or an increase in length is accomplished in the presence of play by means of the pressure of the lubricating oil, and a reduction in length caused by a minor flow of leakage oil in conjunction with the cam of the camshaft that compresses the compensating element.

Such a valve-play compensation element is known from DE-OS 38 19 927, where provision is made in connection with a hydraulic valve-play compensation element of the commonly employed type for an additional check valve which, when the engine is at a standstill, is expected to prevent draining of the oil-filled supply chamber located upstream of the high-pressure chamber. However, what is not prevented in this connection is that as long as the play compensation element is loaded by the cam of the camshaft, with the valve in the open condition and the engine standing still, the oil filling of the operating or high-pressure chamber is reduced due to the leakage oil passing through between the cylinder part and the piston part, and the length of the play compensation element is reduced accordingly. This is undesirable in the standstill condition because it leads to increased valve play when the engine is subsequently started.

Another hydraulic valve-play compensation element is known from EP 324085, where during the braking operation of the engine, the re-setting function of the hydraulic valve-play compensation element is to be shut down. For this purpose, the hydraulic valve-play compensation element has a sealed high-pressure chamber and a capillary overflow bore, by way of which the "leakage oil" can drain so as to assure that the length of the hydraulic valve-play compensation element is reduced. During the braking operation of the engine, a valve body actuated by a piston is pressed into the valve seat, whereby both the feed to the high-pressure chamber and also the opening of the capillary overflow bore disposed in the surface of the valve seat are closed. Owing to the fact that the capillary overflow bore feeds directly into the seating surface of the valve, the intention presumably is to prevent the pressure effective in the high-pressure chamber from acting also on the valve body as a whole, and from opening the valve in that way. However, it seems uncertain whether or not this goal is achieved.

The invention is dealing with the problem of providing a hydraulic valve-play compensation element that will not change the adjusted length in the idle position even in the presence of high active forces. Said problem is solved by a hydraulic valve-play compensation element according to the present invention The basic idea of the invention is to prevent the loss of leakage oil—which is required in connection with valve-play compensation elements for such elements to function from occurring between the cylinder part and the piston part when the engine is at a standstill. According to the invention, this is accomplished in that the leakage oil is admitted into the space located between the check valve of the high-pressure chamber and a second valve. When the engine is at a standstill, this leads to a self-reinforcing sealing function of the second valve. The precondition that needs to be satisfied for this to occur is that the leakage oil cannot drain by any other passageway. Therefore, the gap between the cylinder part and the piston part of the valve-play compensation element has to be sealed in a special way on the other side of the overflow bore, for example by providing for particularly narrow play or for a special seal.

Since the play compensation function would be obstructed if a sealed space were created from which the leakage oil cannot escape, it has to be assured for the operation of the engine that the leakage oil is capable of escaping. This is accomplished according to the invention in that the second valve on the supply side is opened and kept open during the operation of the engine by means of a piston that is actuated by a defined force.

By designing the actuating piston as a component through which the lubricating oil is flowing, it is possible to achieve a space-saving design as compared to the hydraulic valve-play compensation element shown in EP 324085.

The invention is described in the following with the help of an exemplified embodiment. In the drawing, FIG. 1 shows a valve-play compensation element as defined by the invention.

The valve-play compensation element consists of a cylinder part 1 and a piston part 2. Said components are clamped against each other by a spring 3. The relative movement between the cylinder part 1 and the piston part 2 is limited in this connection by a spring ring 8. The feed of the oil takes place through the feed bore 19 in the pressure piece 7.

The spring 3 is located in a high-pressure or operating chamber 20 formed between the cylinder part 1 and the piston part 2. Said high-pressure or operating chamber is sealed by a check valve 4 comprising a closing part 11, a valve spring 12 and a valve cage 13. The valve-play compensation element corresponds to that extent with the conventional design.

A second valve 5 is located in the direction of flow upstream of the check valve 4. Said second valve has a valve cage 10 with an integrated valve spring, and a closing part 9.

The closing part 9 can be lifted from the valve seat by an actuating piston 6 against the pressure of the valve spring. At its top side, the actuating piston 6 has an active surface for the oil pressure applied that is greater than the one on its underside. The force acting as a result thereof on the piston 6 is available for the opening function of the valve and is transmitted to the closing part 9 via the surface 16. The leakage oil escaping between the piston part 2 and the actuating piston 6 flows without pressure from the hydraulic valve-play compensation element via the relieve bore 14.

The piston 6 has a bore by way of which oil can flow from the reservoir chamber 19 into the high-pressure chamber 20 via the supply chamber 18 and the chamber 17 located between the valves.

The leakage oil that may drain from between the cylinder part 1 and the piston part 2 under certain circumstances such as, for example in connection with shaft-actuated valves also while the engine is at a standstill, is fed via the overflow bore 21 to the chamber 17 located between the valves 4 and 5, and, with the valve 5 closed, acts in a reinforcing manner on the sealing function said valve 5. In order to largely prevent loss of pressure in the chamber 17, provision is made for a ring seal 15 that located between the cylinder part 1 and the piston part 2.

What is claimed is:

1. A hydraulic valve-play compensation element for an internal combustion engine, with a cylinder part (1) and a piston part (2) displaceable in the cylinder part, whereby the cylinder part (1) and the piston part (2) are initially tensioned against each other by a spring (3), and enclose a high-pressure chamber, said chamber being closed by a check valve (4) located on a high pressure side; and with a second valve (5) located on a supply side upstream of the check valve (4) in the direction of the oil feed, whereby the valve (5) located on the supply side is closed by a return spring (10) when the engine is at a standstill, characterized in that when the check valve (4) is closed, leakage oil draining from the high-pressure chamber (20) is guided into the space (17) located between the check valve (4) and the valve (5), and reinforces there the sealing function of the valve (5) when the engine is standing still; that the valve (5) is opened when the engine is in operation by means for generating a defined force in the feeding direction; and that when the engine is operating, the valve (5) is kept open by the means for generating the defined force irrespective of the direction of through-flow of the lubricating oil.

2. The hydraulic valve-play compensation element according to claim 1, characterized in that at least one sealing ring (15) is arranged between the cylinder part (1) and the piston part (2).

3. The hydraulic valve-play compensation element according to claim 1, characterized in that the force for opening the valve (5) is a force of an actuating piston (6) generated by the pressure of the lubricating oil.

4. The hydraulic valve-play compensation element according to claim 3, characterized in that the lubricating oil pressure is applied to both sides of the actuating piston (6); and that the force for opening the valve (5) is generated as a result of different acting surfaces.

5. The hydraulic valve-play compensation element according to claim 3, characterized in that the oil flows through the actuating piston (6).

6. The hydraulic valve-play compensation element according to claim 2, characterized in that the force for opening the valve (5) is an electromagnetically generated actuating force.

7. The hydraulic valve-play compensation element according to claim 1, characterized in that a capillary overflow bore is arranged between the high-pressure chamber (20) and the space located between the valves (4 and 5).

* * * * *